US011396778B2

(12) United States Patent
Jones

(10) Patent No.: US 11,396,778 B2
(45) Date of Patent: Jul. 26, 2022

(54) TELESCOPIC DRILL ROD

(71) Applicant: Jim Jones, Canton, GA (US)

(72) Inventor: Jim Jones, Canton, GA (US)

(73) Assignee: Keller North America, Inc., Hanover, MD (US)

( * ) Notice: Subject to any disclaimer, the term of this patent is extended or adjusted under 35 U.S.C. 154(b) by 0 days.

(21) Appl. No.: 17/114,129

(22) Filed: Dec. 7, 2020

(65) Prior Publication Data

US 2021/0172262 A1 Jun. 10, 2021

Related U.S. Application Data

(63) Continuation-in-part of application No. 16/091,382, filed as application No. PCT/US2017/026184 on Apr. 5, 2017, now Pat. No. 10,858,896.

(60) Provisional application No. 62/318,252, filed on Apr. 5, 2016.

(51) Int. Cl.

| | |
|---|---|
| ***E21B 17/07*** | (2006.01) |
| ***E21B 19/084*** | (2006.01) |
| ***E21B 7/20*** | (2006.01) |
| ***E21B 19/00*** | (2006.01) |
| ***E21B 7/00*** | (2006.01) |
| ***E21B 17/02*** | (2006.01) |
| ***E21B 17/042*** | (2006.01) |
| ***E21B 17/043*** | (2006.01) |

(52) U.S. Cl.

CPC ..... *E21B 17/07* (2013.01); *E21B 7/00* (2013.01); *E21B 7/20* (2013.01); *E21B 17/02* (2013.01); *E21B 17/043* (2013.01); *E21B 17/0426* (2013.01); *E21B 19/00* (2013.01); *E21B 19/084* (2013.01)

(58) Field of Classification Search

CPC ..... E21B 17/07; E21B 19/084; E21B 7/20; E21B 19/00; E21B 7/00; E21B 17/02; E21B 17/0426; E21B 17/043; F16L 15/02; F16L 39/005

See application file for complete search history.

(56) References Cited

U.S. PATENT DOCUMENTS 1,635,289 A * 7/1927 Scott ..... E21B 17/07 285/302
2,206,873 A * 7/1940 Boynton ..... E21B 17/043 285/89
2,497,986 A * 2/1950 Goode ..... F16L 15/02 285/32
3,778,089 A * 12/1973 Fredd ..... F16L 15/008 285/39

(Continued)

*Primary Examiner* — Nicole Coy

(74) *Attorney, Agent, or Firm* — Royal W. Craig; Gordon Feinblatt LLC

(57) ABSTRACT

A telescopic drill rod has at least two rod members disposed coaxially to one another, with the inner rod member being axially slidable relative to the outer rod member in a telescoping manner between an extended position and a retracted position. Both the inner rod member and outer rod member are equipped with joints at each end for connection to a drill head and/or another section of drill pipe. The joints also lock the inner and outer rod members in either the extended or retracted positions, and this is accomplished with a unique frusto-conical threaded engagement that is well-suited for transmitting pressure forces.

14 Claims, 2 Drawing Sheets

(56) References Cited

U.S. PATENT DOCUMENTS 3,994,516 A * 11/1976 Fredd ..... E21B 17/07
285/39
5,368,083 A * 11/1994 Beck, III ..... E21B 3/04
175/195

* cited by examiner

TELESCOPIC DRILL ROD

CROSS-REFERENCE TO RELATED APPLICATION(S)

The present application is a continuation-in-part of U.S. application Ser. No. 16/091,382 filed Oct. 4, 2018 which is a National Stage Entry of PCT/US17/26184 filed Apr. 5, 2017 which claims priority from PPA 62/318,252 filed Apr. 5, 2016.

BACKGROUND OF THE INVENTION

1. Field of the Invention

The present invention relates to drill rods for ground (soil and rock) drilling equipment, and more particularly, to drill rods comprising a number of members extendable in the manner of a telescope. The rods can be used with non-telescoping rods or with additional telescoping rods to allow ground drilling connecting a drilling rig to a drilling bit to allow for drill hole advancement.

2. Description of the Background

Mobile drill rigs are typically used for earth drilling in various geologic drilling applications. The mobile drill rig typically includes a drill mast mounted onto a truck chassis. A rotatable drill head is slideably mounted on the drill mast and can be driven up or down along the length of the erected drill mast. The drill head screws a drill string into the ground, gripping and turning the uppermost section of drill pipe of the string.

Drill pipe, is hollow, thin-walled, steel piping and comes in a variety of sizes, strengths, and weights but are typically within a range of from 5 to 40 feet in length. They are hollow to allow drilling fluid to be pumped through them, down the hole, and back up.

In practice, the drill string is extended by drilling in each drill rod sequentially and by attaching the next rod to the trailing end of the drill string, and repeating. This change-over is difficult, time consuming and sometimes dangerous.

It would be highly desirable to provide a drill rod that can be used for drilling a bore and also limit the number of assembly iterations required to advance the drill hole The present invention does this with a telescopically extendable drill rod that may be extended during the actual drilling operation thereby avoiding any need to assemble further sections to the drill rod in order to extend it. The present invention also allows the use of a shorter drill mast, which in turn requires fewer tooling additions and smaller and more economical equipment. Also, the shorter drill masts facilitates drilling in limited access conditions that would preclude the use of large equipment with longer drill masts.

One skilled in the art will understand that Kelly drilling employs "telescopically extendable" drill attachments in a loose sense. Kelly drilling is often used for oil drilling and for the production of foundation piles for buildings. In this case, the rotary drive of the drill turns a Kelly rod arrangement, which comprises several nested tubular Kelly rods of square cross-section. The rotational movement of one rod is transmitted to the adjacent Kelly rod. Kelly rod attachments can be added down the hole. Kelly drilling is good for larger holes and rocky formations but is not well-suited for "tie-back" (micropile) drill rigs and other small hole drilling rigs, A tieback is a horizontal wire, rod, or helical anchor used to reinforce retaining walls for stability. With one end of the tieback secured to the wall, the other end is anchored to a micropile anchored in the earth. The tieback-pile structure resists forces that would otherwise cause the wall to lean. What is needed is a telescopically extendable drill rod more suitable for use with tieback drill rigs (alternately known as micropile drill rigs) suitable for use in a wide range of small-hole drilling applications including anchor drilling, micropiles, soil nailing, water wells and jet grouting, and other such smaller hole drilling.

SUMMARY OF THE INVENTION

An object of the invention is to provide a telescopic drill rod which is of the simplest possible construction but which is nevertheless able to transmit drilling pressure when in the extended position. A further object of the invention is to enable the individual members of the rod, while in the extended position, to be easily connected together and also easily disconnected using standard rotary tieback drilling equipment for installations substantially similar to those as described above.

The invention comprises a telescopic drill rod comprising at least two rod members disposed coaxially to one another, including an inner rod member and an outer rod member axially slidable relative to each other in a telescoping manner between an extended position and a retracted position. Both the inner rod member and outer rod member are equipped with joints at each end for connection to a drill head and/or another section of drill pipe. The joints also lock the inner and outer rod members in either the extended or retracted positions, and this is accomplished with a unique frusto-conical threaded engagement that is well-suited for transmitting pressure forces.

The invention makes it possible for the members of a telescopic drill rod to be coupled together in the extended position, without further aids or additional devices, in a simple, convenient manner which is particularly suitable for practical operation, in such a manner that rotational and axial drilling forces with or without drilling fluid use can be applied.

For a more complete understanding of the invention, its objects and advantages, refer to the remaining specification and to the accompanying drawings.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

The present invention is a telescopic drill rod comprising two or more rod members: at least including an inner rod member and an outer rod member axially slidable relative to each other in a telescoping configuration between an extended position and a retracted position.

Figure 1:
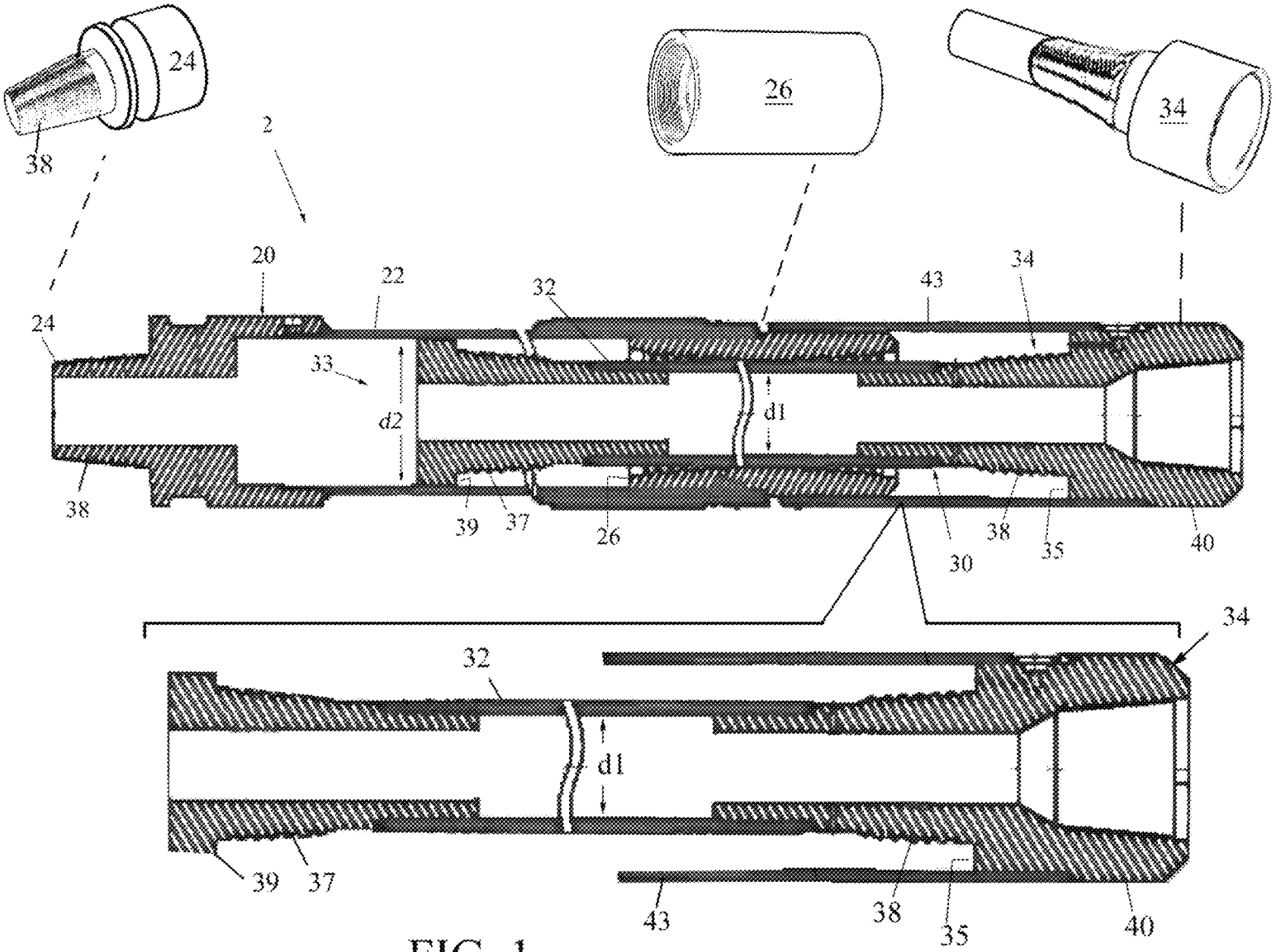
FIG. 1 is a side cross-section of a telescopic drill rod 2 in its unsecured intermediate position according to an embodiment of the invention with enlarged insets of some components.

FIG. 1 is a side cross-section of a telescopic drill rod 2 according to an embodiment of the invention shown in an intermediate (unsecured) position. The telescopic drill rod generally comprises the inner rod member 30 and outer rod member 20, inner rod member 30 being slidably carried in telescoping manner within the outer rod member 20. The outer rod member 20 is configured for attachment to a drill rig and the inner rod member 30 is configured for attaching a drill bit, albeit multiple drill rods 2 may be coupled together end-to-end. In either case the outer rod member 20 can be secured in a fully retracted position (shown and described below with reference to FIG. 2), unsecured as shown in FIG. 1 for free telescoping extension or retraction, or fully extended and secured in the fully extended position (shown and described below with reference to FIG. 3).

The inner rod member 30 further comprises an elongate hollow pipe section 32 of uniform or variable cross-section d1 extending from a flared joint 33 at one end that widens progressively along a threaded surface 37 to a raised collar 39 of diameter d2 at the upper end or top of the drill rod 2. Inner rod member 30 extends to an opposing lower flared joint 34 at the other end terminating at a raised collar 35 of diameter d2. Pipe section 32 preferably has a uniform cross-section along its length symmetric about a central axis, and subject to that constraint may be cylindrical, hexagonal, octagonal or otherwise.

As seen in the enlarged right inset to FIG. 1 lower flared joint 34 comprises a pronounced bulbous tip of larger cross-section than d1 and flared gradually along a frusto-conical threaded surface 38 expanding outward and distally to a raised medial collar 35 of diameter d2, and continuing to a bulbous distal socket 40. In the preferred embodiment threaded surface 38 is left-hand screw-threaded along its length. The frusto-conical shape provides a wedging effect. The collar 35 is of slightly greater diameter d2 than the largest threads of surface 38 and presents a smooth flat surface to serve as a bushing for slidable engagement with the inner surface of outer rod member 20. The smallest threads of surface 38 are of slightly greater width/diameter d1 than the hollow pipe section 32. The inner rod member 30 has a hollow center channel that extends continuously through the entire inner rod member 30 and maintains a uniform cross-section through a majority of its length to approximately the socket 40 of lower flared joint 34. At that point it expands into a receptacle within socket 40 that is shaped, dimensioned and threaded for screw-insertion of a conventional drill head (not shown) or, alternatively, for screw-insertion of another drill rod 2. A length of larger pipe section 43 is carried on the lower flared joint 34 for telescoping engagement with the outer rod member 20.

The outer rod member 20 further comprises an elongate hollow pipe section 22 of uniform or variable cross-section with an internal diameter d2 extending from a cap 24 at one end to a double-female joint 26 that is compression and/or screw-threaded into the end of pipe section 22. Pipe section 22 preferably has a uniform cross-section along its length symmetric about a central axis, and subject to that constraint may be cylindrical, hexagonal, octagonal or otherwise.

As seen in the enlarged center inset to FIG. 1 double-female joint 26 is compression fit and/or screw-threaded into the end of pipe section 22, and remains attached thereto, and slidably engages pipe section 43. In the illustrated embodiment double-female joint 26 is a hollow tubular cylindrical section having a two-tier exterior dimension for flush insertion into the pipe section 22. The interior of the double-female joint 26 is a double-conical frustum constricted mid-length, and flared and threaded outward on both sides. The top end receptacle of double-female joint 26 is shaped, dimensioned and threaded to conform to the frusto-conical threaded surface 37 of upper flared joint 33 for screw-insertion therein. The bottom end receptacle of double-female joint 26 is shaped, dimensioned and threaded to conform to the frusto-conical threaded surface 38 of lower flared joint 33 for screw-insertion therein. The mid-point presents a cylindrical lip having a diameter slightly more than d1. Once more, tapered-conical or non-tapered threads may be used.

One skilled in the art will understand that non-tapered threads are suitable, in which case the double-female joint 26 is of substantially uniform internal cross-section with non-tapered threads. The double-female joint 26 may optionally be internally grooved mid-length for holding a rubberized rod wiper, e.g., an O-ring or other such wiping device or mechanism, captive therein where wiping might be of advantage to the drilling. A rod wiper squeegees the inner pipe section 32 clean as is slides through.

As seen in the enlarged left inset to FIG. 1, cap 24 is compression fit and/or screw-threaded onto the end of pipe section 22, remains attached thereto, and presents an internal flange 31 that constrains telescoping of the inner rod member 30. The distal top end of cap 24 comprises a threaded male coupling 38 that is shaped, dimensioned and threaded exactly like a conventional drill head coupling (not shown) or, alternatively, for screw-insertion into the distal socket 40 of another drill rod 2.

The length of outer rod member 20 is L1, and inner rod member 30 is L2, giving a sum component length of L1+L2. However, it should now be apparent that the invention makes it possible for the inner and outer members 30, 20 of the telescopic drill rod 2 to be securely coupled together in the retracted and/or extended position by screw-insertion, without aid from further devices, in a simple, convenient manner. The present configuration optimizes both extension and retraction without compromising strength and security when locked in either the fully extended or fully retracted position.

Figure 2:
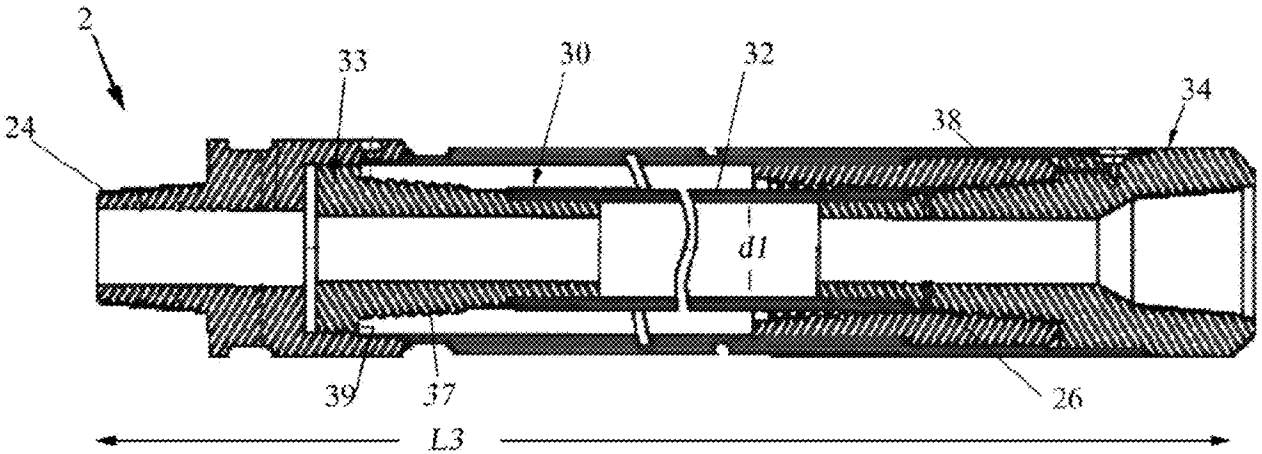
FIG. 2 shows the telescopic drill rod 2 secured in its fully-retracted position.

FIG. 2 shows the telescopic drill rod 2 in its fully-retracted position with the threaded surface 38 on the lower-flared joint 34 of inner rod member 30 screw-inserted into the lower receptacle of the double female joint 26 of outer rod member 20. In this position the total length L3 is greater than L1 by about the length of cap 24.

Figure 3:
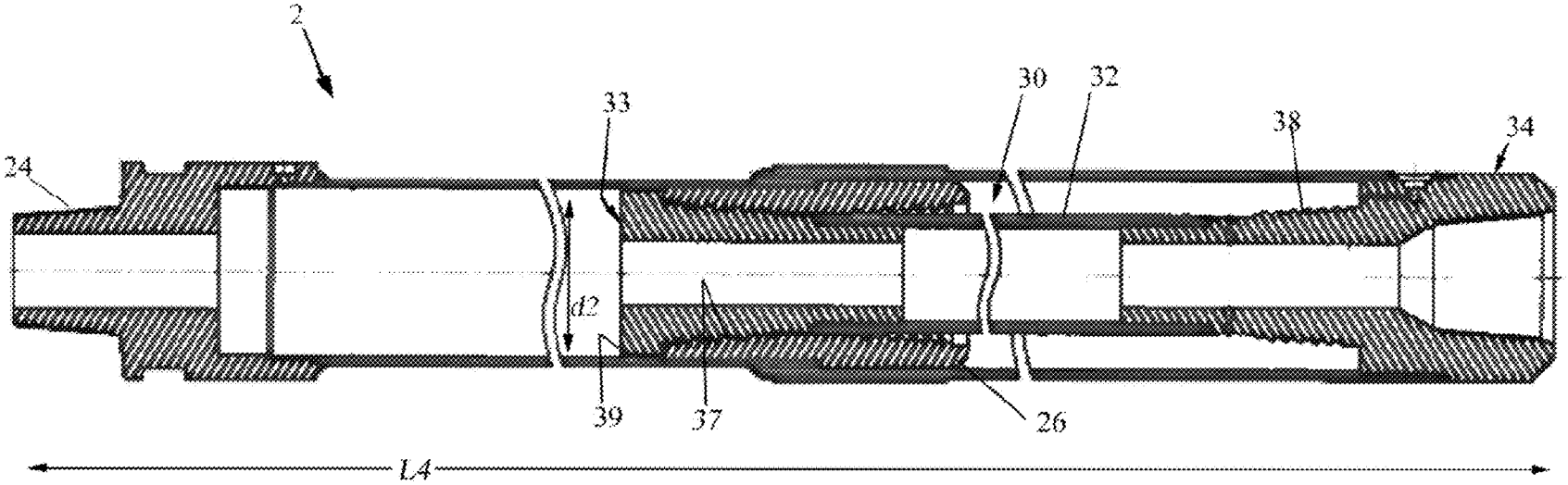
FIG. 3 shows the telescopic drill rod 2 secured in its fully-extended position

FIG. 3 shows the telescopic drill rod 2 in its fully-extended position with the threaded surface 37 on the upper-flared joint 33 of inner rod member 30 screw-inserted into the upper female receptacle of the double-female joint 26 of outer rod member 20. In this position L4 is slightly less than L1+L2 by a bit more than the length of the double female joint 26.

In the above-described embodiment both the leftside (upper) receptacle of double-female joint 26 and the threaded surface 37 are left-hand screw-threaded such that clockwise rotation of outer rod 20 relative to inner rod 30 turns the lower flared-joint 34 and drill bit clockwise. During assembly this tightens the threaded surface 37 into the upper receptacle of double female joint 26 to lock the inner rod 30 in its extended position relative to outer rod 20 (see FIG. 3). The threaded surface 37 of the upper-flared joint 33 of inner rod member 30 continues screw-insertion into the upper (left) receptacle of double female joint 26 until the raised collar 39 of diameter d2 at the upper (left) of inner rod 30 locks flush against the upper receptacle of double female joint 26. Afterward, clockwise drilling applied from a drill rig to cap 24 and outer rod 20 will only tighten the threaded surface 37 into the upper receptacle of double-female joint 26, securing the connection rather than unscrewing it. Were these threads not left handed, the inner rod 30 and outer rod 20 would come unthreaded as soon as one encountered any drilling resistance. All other threaded surfaces including that of the lower receptacle of the double female joint 26 and 38 of lower flared-joint 34 are right-handed. The collar 39 resists the axial force of threads 37 resulting in a compressive preload to the entire upper-flared joint 33 of inner rod member 30, which substantially strengthens the upper-flared joint 33. This is important because as the telescopic drill rod 2 drills down into the ground in its fully-extended position outer rod 20 pushes down in the inner rod 30 which exerts substantial axial and rotational force upon the mating threads 37, 26. However, the compression of rods 20, 30 pulls the upper-flared joint 33 out of the upper receptacle of double female joint 26. The axial tension from drilling offsets the compressive preload of collar 39 which strengthens the upper joint and increases useful life.

Alternately, one skilled in the art will understand that the invention may be adapted for unconventional counterclockwise drilling. In this case both the leftside (upper) receptacle of double-female joint 26 and the threaded surface 37 are right-hand screw-threaded such that clockwise rotation of outer rod 20 relative to inner rod 30 screws the threaded surface 37 into the upper receptacle of double female joint 26 to lock the inner rod 30 in its extended position relative to outer rod 20 (see FIG. 3). Afterward, counter-clockwise drilling applied from a drill rig to cap 24 and outer rod 20 will only tighten the threaded surface 37 into the upper receptacle of double-female joint 26, securing the connection rather than unscrewing it. All other threaded surfaces including that of the lower receptacle of the double female joint 26 and 38 of lower flared-joint 34 are left-handed.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A telescopic drill rod, comprising two or more rod members at least including:

an outer rod member comprising a hollow pipe section extending between one end configured for attachment to a drill rig and a double-female joint at another opposing end, the double-female joint further comprising an interior screw-threaded first receptacle extending axially into said hollow pipe section and having left-handed screw threads, and an interior-screw-threaded second receptacle open outward from said hollow pipe section; and an inner rod member engaged to said outer rod member and configured for slidable reciprocation therein, said inner rod member being configured for attaching a drill bit at one end and having a flared joint at another opposing end comprising a left-handed externally-screw-threaded surface configured to screw-engage the left-handed screw threads of the first receptacle of the double-female joint of said outer rod member.

2. The telescopic drill rod of claim 1, wherein the externally-screw-threaded surface of the flared joint of the inner rod member flares outward to and abuts a distal collar.

3. The telescopic drill rod according to claim 1, wherein the hollow pipe section of said outer rod member further comprises a cylinder.

4. The telescopic drill rod according to claim 3, wherein the hollow pipe section of said outer rod member further comprises a cylinder.

5. The telescopic drill rod according to claim 4, wherein the hollow cylindrical pipe section of said outer rod member has an internal diameter less than the internal diameter of the hollow cylindrical pipe section of said inner rod member.

6. The telescopic drill rod according to claim 1, wherein the double-female joint first receptacle and second receptacle are flared outward from a midpoint, said first receptacle having an interior screw-threaded surface with tapered left-handed screw threads and said second receptacle having an interior screw-threaded surface with tapered right-handed screw threads.

7. The telescopic drill rod according to claim 6, wherein the screw-threaded surfaces of the first receptacle and second receptacle comprise oppositely-tapered threads.

8. A telescopic drill rod, comprising two or more rod members at least including:

an outer rod member comprising a hollow pipe section extending between one end configured for attachment to a drill rig and a double-female joint at another opposing end, the double-female joint further comprising an interior screw-threaded first receptacle extending axially into said pipe section and having left-handed screw threads, and an interior-screw-threaded second receptacle open outward from said pipe section; and an inner rod member engaged to said outer rod member and configured for slidable reciprocation therein, said inner rod member being configured for attaching a drill bit at one end and having a flared joint at another opposing end comprising a left-handed externally-screw-threaded surface for engaging the left-handed screw threads of the first receptacle of the double-female joint of said outer rod member.

9. The telescopic drill rod of claim 8, wherein the externally-screw-threaded surface of the flared joint of the inner rod member flares outward to and abuts a distal collar.

10. The telescopic drill rod according to claim 8, wherein the hollow pipe section of said outer rod member further comprises a cylinder.

11. The telescopic drill rod according to claim 10, wherein the hollow pipe section of said outer rod member further comprises a cylinder.

12. The telescopic drill rod according to claim 8, wherein the hollow cylindrical pipe section of said outer rod member has an internal diameter less than the internal diameter of the hollow cylindrical pipe section of said inner rod member.

13. The telescopic drill rod according to claim 8, wherein the double-female joint first receptacle and second receptacle are flared outward from a midpoint, said first receptacle having an interior screw-threaded surface with tapered left-handed screw threads and said second receptacle having an interior screw-threaded surface with tapered right-handed screw threads.

14. The telescopic drill rod according to claim 13, wherein the screw-threaded surfaces of the first receptacle and second receptacle comprise oppositely-tapered threads.

* * * * *